US005147528A

United States Patent [19]

Bulatovic

[11] Patent Number: 5,147,528

[45] Date of Patent: Sep. 15, 1992

[54] PHOSPHATE BENEFICIATION PROCESS

[75] Inventor: Srdjan Bulatovic, Peterborough, Canada

[73] Assignee: Falconbridge Limited, Toronto, Canada

[21] Appl. No.: 681,817

[22] Filed: Apr. 8, 1991

Related U.S. Application Data

[63] Continuation-in-part of Ser. No. 508,385, Apr. 12, 1990, abandoned.

[51] Int. Cl.[5] ..... B03D 1/006; B03D 1/008; B03D 1/01; B03D 1/02

[52] U.S. Cl. ..... 209/166; 209/167; 252/61; 241/24

[58] Field of Search ..... 209/166, 167, 902; 252/61; 241/20, 24

[56] References Cited

U.S. PATENT DOCUMENTS

| | | | |
|---|---|---|---|
| 1,761,546 | 6/1930 | Trotter | 209/166 |
| 2,826,301 | 3/1958 | Le Baron | 209/166 |
| 2,987,183 | 6/1961 | Bishop | 209/166 |
| 3,032,189 | 5/1962 | Adam | 209/166 |
| 3,032,195 | 5/1962 | Fenscke | 209/166 |
| 3,067,875 | 12/1962 | Fenscke | 209/166 |
| 4,189,103 | 2/1980 | Lawver | 209/166 |
| 4,358,368 | 11/1982 | Hellsten | 209/166 |
| 4,440,636 | 4/1984 | Lilley | 109/166 |
| 4,556,545 | 12/1985 | Cheruvu | 209/166 |
| 4,612,112 | 9/1986 | Swiatkowski | 209/166 |
| 4,732,667 | 3/1988 | Hellsten | 209/166 |
| 4,772,382 | 9/1988 | Bulatovic | 209/166 |
| 4,789,466 | 12/1988 | Von Rybinski | 209/166 |
| 4,853,113 | 8/1989 | Bulatovic | 209/166 |

FOREIGN PATENT DOCUMENTS

| | | | |
|---|---|---|---|
| 610190 | 12/1960 | Canada | 209/166 |
| 760562 | 12/1981 | U.S.S.R. | 209/166 |
| 666709 | 5/1982 | U.S.S.R. | 209/166 |
| 1528567 | 12/1989 | U.S.S.R. | 209/166 |
| 2207619 | 2/1989 | United Kingdom | 209/166 |

*Primary Examiner*—Stanley S. Silverman
*Assistant Examiner*—Thomas M. Lithgow
*Attorney, Agent, or Firm*—Bereskin & Parr

[57] ABSTRACT

A process for the froth flotation separation of phosphate containing minerals by the use of a new collector agent is described. The new phosphate collector agent is prepared by mixing a fatty acid, tall oil pitch, an amine, and optionally sarcosine with fuel or furnace oil, and subsequently oxidizing the mixture by known methods. The new phosphate collector agent is added to the conditioned slurry of the ground and deslimed phosphate containing ore. The slurry is then subjected to froth flotastion in one or more stages to collect the phosphate concentrate in the froth. The phosphate collector agent is also effective in recovering phosphates from slime.

7 Claims, 3 Drawing Sheets

PHOSPHATE BENEFICIATION PROCESS

This application is a continuation-in-part of application Ser. No. 508,385, filed Apr. 12, 1990 (now abandoned).

FIELD OF THE INVENTION

This invention relates to the beneficiation of phosphate containing ores. More specifically, the invention relates to the froth flotation separation of phosphate minerals contained in ores.

BACKGROUND OF THE INVENTION

Phosphate containing compounds are major ingredients of such industrial products as fertilizers, chemical reagents, pigments, etc. In most cases, such phosphates are produced by means of utilizing phosphoric acid reagent. Phosphoric acid is usually obtained by the treatment of phosphate minerals contained in various oxidic ores. Phosphate minerals are major constituents in ores such as apatite, phosphorite and pebble phosphates. Phosphate minerals may also occur as minor constituents in many other oxidic ores, for instance in dolomitic ores and similar alkaline earth metal carbonates, and are usually accompanied by quartz and other siliceous gangue minerals. In the above instances, the phosphate minerals need to be separated from other constituents of the ore and from the gangue, by a beneficiation process to yield a phosphate mineral concentrate. The phosphate mineral concentrate so obtained may subsequently be treated to produce phosphoric acid.

It is usual in a beneficiation process to first grind the ore to a suitable liberation size. Grinding may be wet or dry. Conventional benefication processes often include a step to remove particles of very small size from the ground ore before the ore is subjected to further beneficiation. The fine particles are usually referred to as slimes, and the removal of fine particles is usually termed desliming.

The actual size of the particles which are considered as slime depends on the composition of the minerals contained in the ore, the chemical and physical nature of the small particles, the various chemical reagents used in subsequent steps and the character of the mineral values which are retained in the slime. Thus slime separation and treatment will be governed by chemical, physical and economic considerations. In phosphate beneficiation processes, particle sizes less than generally 200 Tyler mesh are considered as slime.

The ground ore may undergo other conventional mineral beneficiation steps, such as for instance, magnetic separation before or after desliming. The insertion of such steps are dictated by the nature of the ore and economic considerations only.

Froth flotation separation commonly forms a part of a beneficiation process. The ground ore is usually made into an aqueous slurry and added to the slurry are chemical reagents which may be preferentially adsorbed by particles containing value minerals. The chemical reagents adsorbed on the surface of particles will either enhance wetting by water or diminish wetting of certain particles. These chemical reagents are generally referred to as collector agents or depressant agents. Collector agents are chemical reagents which when adsorbed on the surface of a particle diminish the wetting of the particle by water. Depressant agents are those chemical reagents which usually enhance the wetting of particles. In a conventional froth flotation process air bubbles are introduced into the aqueous slurry. The air bubbles usually attach themselves to the non-wetted particles, thereby raising them to the top or froth of the slurry. The froth is usually skimmed off and/or is channelled off in an overflow. The froth thus contains the concentrate of certain value minerals which have not been wetted by water as a result of interaction with reagents added in the flotation separation process. The particles wetted, on the other hand, tend to be depressed into the residue of the froth flotation process.

The froth flotation step is usually preceded by a conditioning step whereby reagents are added to the ore slurry in order to enhance the adsorption of depressing agents and collector agents onto the surface of the ore particles. A frother may also be added to the conditioned ore slurry to promote the generation of froth.

Conventional phosphate beneficiation may include two separate froth flotation step sequences. In the first step sequence, froth flotation is performed with a fatty acid collector to obtain a low grade phosphate product. The low grade product is then treated with an acid for the removal of the fatty acid reagent before the fraction so obtained may be subjected to a second froth flotation step sequence, utilizing an amine flotation reagent to float preferentially the gangue particles. U.S. Pat. No. 4,189,103 issued Feb. 19, 1980 to Lawver et al., describes such a complex phosphate beneficiation process which additionally includes several size separation and gravity separation steps. The process of U.S. Pat. No. 4,189,103 utilizes fatty acid flotation reagents in one of its stages and an amine froth flotation agent in another stage. In another patented process, U.S. Pat. No. 4,372,843 issued in Feb. 8, 1983 to Lawver et al., the pebble fraction obtained in the size separation is ground to a smaller size and then subjected to reverse flotation. In the reverse flotation the phosphate minerals are depressed into the underflow of the froth flotation cell. U.S. Pat. No. 4,372,843 utilizes a sulphonated fatty acid carbonate collector and a phosphate depressant.

In conventional direct phosphate froth flotation processes reagents are added for depressing quartz, dolomite and similar alkali metal carbonates to the tailing. A .dolomitic phosphate beneficiation process is described in U.S. Pat. No. 4,804,462 issued on Feb. 14, 1989 to Zheng-xing Gu et al. In that process the ore is subjected to several conditioning stages with a fatty acid and fuel oil reagent, and then to froth flotation steps utilizing humic acid as collector reagent.

Most conventional phosphate beneficiation processes are either very complex and therefore costly, or provide low phosphate recovery rates.

Another disadvantage of most conventional processes is that the slimes separated from the ground ore may not be treated economically for further phosphate recovery and are therefore discarded.

It has now been found that phosphate minerals may be separated in a relatively simple phosphate beneficiation process utilizing a novel phosphate collector agent.

The novel phosphate collector agent of the present invention comprises an oxidized intimate mixture of ingredients comprising initially:

i) 20–60% by weight of a fatty acid containing 12–36 carbon atoms in its hydrocarbon chain, ii) 5–25% by weight of a tall oil pitch, iii) 2.5–15% by weight of an amine derived from a plant, iv) 0–15% by weight of sarcosine, and additionally comprising, as the balance of said mixture, 20–72.5% by weight of one of the group consisting of a fuel oil and furnace oil.

The fuel oil or the furnace oil may be added to the mixture of ingredients either prior to oxidizing or subsequent to it.

The phosphate collector of this invention is added to the ground and deslimed phosphate containing ore which has been slurried in water. For best results the slurried ore is conditioned with a pH modifier, such as sodium carbonate or similar conventional pH adjusting reagent. Other conventional conditioning agents, such as for example alkali metal silicates may be added prior to rougher and/or cleaner flotation stages. The conditioned ore slurry containing the phosphate collector of this invention is then subjected to froth flotation. The phosphate minerals contained in the ore are separated in the froth. The phosphate mineral concentrate so obtained may then be treated in process steps for further recovery.

It is an additional advantage of the present invention that the separated slimes may also be treated in a separate phosphate recovery process step utilizing the novel phosphate collector agent.

Figure 1:
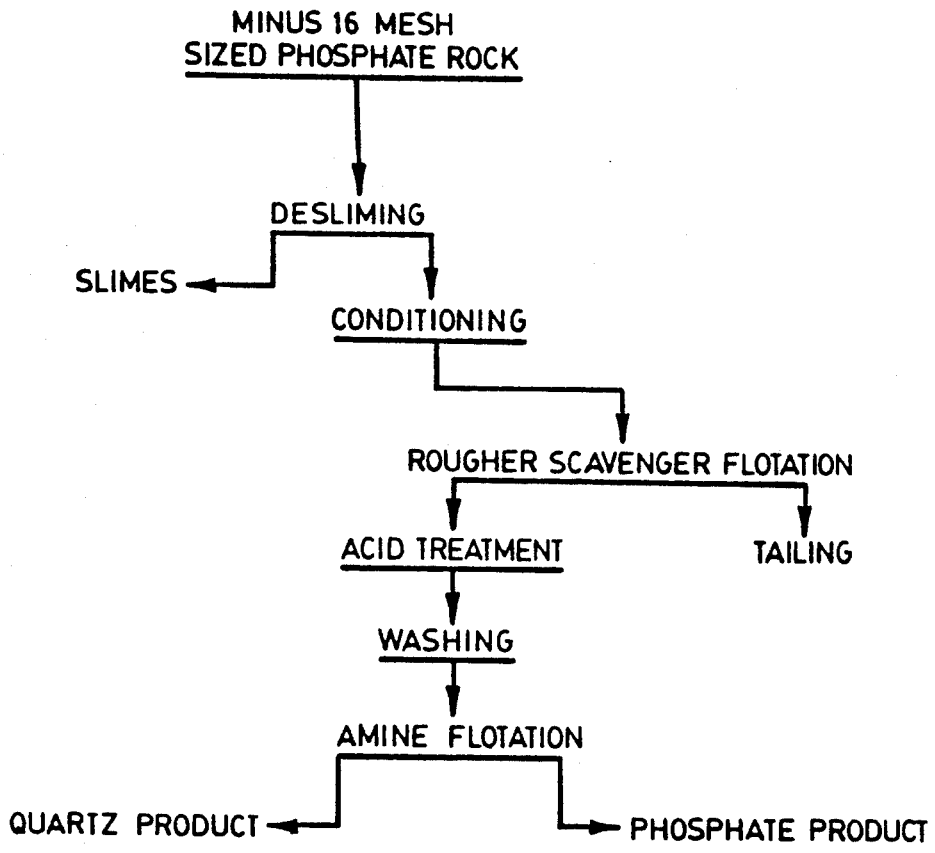
FIG. 1 is a schematic flowsheet of a conventional phosphate beneficiation process.

The preferred embodiment of the present invention will be described below and illustrated by means of working examples.

The phosphate collector agent of this invention is prepared by first intimately mixing the ingredients and then oxidizing the mixture.

One of the ingredients of the phosphate collector is a fatty acid. Fatty acids are usually a mixture of monocarboxylic acids having branched or straight hydrocarbon chains. The number of carbon atoms making up the hydrocarbon chain of the fatty acid component utilized in the present invention, may vary from 12 carbon atoms to 36 carbon atoms. It is usual that hydrocarbons of two or three different chain lengths predominate in the fatty acid component. Exemplary fatty acids which may be used as an ingredient of the phosphate collector is Westvaco L-5* and Pamak C-4*. Westvaco L-5 is marketed by Westvaco Inc. and Pamak C-4 is marketed by Hercules Incorporated. Both the above trade named fatty acid compositions contain predominantly 16–18 carbon atoms in their hydrocarbon chains. Another type of fatty acid which may serve as an ingredient of the phosphate collector of the present invention, is one in which oleic and linoleic acids predominate. Oleic and linoleic acid both contain 18 carbon atoms, however, oleic acid has one unsaturated carbon to carbon bond and linoleic acid has two such bonds. An exemplary fatty acid containing a mixture of oleic and linoleic acids is manufactured and marketed by the Emery Co. as Emersol 305*. A person skilled in the art will understand that similar hydrocarbon chain-containing fatty acid compositions may be substituted for the above described fatty acids in the preparation of the phosphate collector agent.

* Trade Mark

The second ingredient of the collector agent is a tall oil pitch. A tall oil pitch is generally understood to contain a mixture of rosin acids obtained as residue in a distillation process. The substance which is subjected to distillation is usually, but not necessarily, derived from a plant. It is usual that the fatty acid value of a tall oil pitch ranges between 25 and 55, but a tall oil pitch of somewhat different composition may also be suitable in obtaining the phosphate collector agent. In the instant mixture comprising the collector agent Tall Oil Pitch P* was used, which is available as a commercial product sold by Arizona Chemicals Inc. Exemplary Tall Oil Pitch P* has 30–50 fatty acid value.

* Trade Mark

The third ingredient of the collector agent mixture is an amine. A convenient source of an amine utilized in the collector agent is derived from a resinous substance generated in a plant, more particularly a pine resin. An exemplary amine is dehydroabietyl amine. This amine may also be referred to as Amine D*, marketed by Hercules Incorporated. Amine D may be replaced as an ingredient of the collector composition by a suitable chemical equivalent.

* Trade Mark

A fourth ingredient which may make up the phosphate collector agent of the present invention is sarcosine. Sarcosine is also known as methylaminoacetic acid, or methylglycine.

Sarcosine may be replaced by a modified fatty acid composition, and as such may be a component of the fatty acid ingredient or of the tall oil pitch. Thus whether sarcosine is added as a separate ingredient of the phosphate collector agent depends on the composition and nature of the fatty acid and the tall oil pitch utilized in the preparation of the present collector agent.

As a first step, an intimate mixture comprising the four ingredients referred to above, is prepared. The mixture is then further mixed with a fuel oil. A person skilled in the art will be familiar with the boiling point range, volatility and viscosity of a hydrocarbon composition which falls into the category defined as fuel oil. In some instances furnace oil may be added to the mixture in replacement of fuel oil.

In order to prepare the phosphate collector agent of the present invention, the above ingredients may be mixed in a wide range of compositions, depending on the nature of the specific ingredients.

The preferred composition range of ingredients utilized in the preparation of the new phosphate collector agent is the following:

i) 20–60% by weight of a fatty acid containing 12–36 carbon atoms in its hydrocarbon chain,
ii) 5–25% by weight of a tall oil pitch,
iii) 2.5–15% by weight of an amine derived from a plant,
iv) 0–15% by weight of sarcosine, the balance of the mixture being made up by fuel oil or furnace oil.

The order of mixing the ingredients is of no particular significance, and is dictated by convenience only.

After having intimately mixed the ingredients the mixture is oxidized by conventional oxidation methods. The oxidation may be accomplished by sparging the liquid comprising the mixture with an oxygen containing gas. The oxygen containing gas may be pure oxygen, air or oxygen enriched air. It is also possible to add an oxidant such as a peroxide, to the above mixture.

A modified form of the phosphate collector agent of the present invention may be obtained by first mixing the fatty acid, the tall oil pitch, the amine which has been derived from a plant and the sarcosine if required, and then oxidizing the mixture as described hereinabove. The fuel oil is added in the required amount to the already oxidized mixture, thereafter.

The mixing and the oxidation may take place at ambient temperature or at a temperature above the ambient, as long as the constitution of the ingredients in the composition is not changed due to volatilization.

The preferred length of time for sparging the mixture with an oxygen containing gas is 2 to 4 hours. The duration of sparging, however, as a skilled technician knows, will depend on the chemical nature of the ingredients and on the temperature of the mixture.

The phosphate collector agent of this invention may be utilized in the beneficiation of any phosphate containing ore. The collector agent is effective in obtaining a phosphate concentrate in the froth flotation separation of a phosphate source, which concentrate may then be treated in a phosphoric acid production process.

In the preferred embodiment, the phosphate containing ore is first ground to a suitable liberation size in conventional wet or dry grinding process steps. The ground ore is then deslimed to remove fine particles. The deslimed ore usually is of a particle size larger than 70 μm, but the particle size range is dictated by convenience only. The deslimed ore is then made into an aqueous slurry with water. It is usual to enhance the efficacy of the collector agent by conditioning the slurried ore particles with the agitated additions of regulators, depressants, and activators.

The phosphate collector agent of the present process is generally added in quantities of 250–2500 g/t to the conditioned aqueous ore slurry. The ore slurry containing the phosphate collector, is subjected to froth flotation process steps. It is usual to include a rougher and a cleaner flotation stage in the froth flotation process. The number of flotation stages in the phosphate beneficiation process is decided upon by considering the nature of the ore and various economic factors.

The phosphate beneficiation process utilizing the present collector agent is relatively simple due to the highly selective nature of the collector and does not require any reverse flotation step.

The slime removed from the coarser fraction of the phosphate bearing ore is often fairly rich in value phosphate minerals. An additional advantage of the novel phosphate collector is that it may be utilized in recovering phosphates lost in the slimes in conventional phosphate beneficiation processes. It has been found that the above-described froth flotation process steps are equally effective in obtaining phosphate concentrates from the separated slime fraction, provided the froth flotation process is conducted in the presence of the phosphate collector agent of this invention.

The working of the invention described herein will now be illustrated by examples.

EXAMPLE 1

The collector agent of the present invention was prepared to be applied in a phosphate ore beneficiation process.

The ingredients were made up and mixed in the following amounts:

i) Fatty acid in the form of Westvaco L-5*—40% by wt.

ii) Tall oil pitch in the form of Tall Oil Pitch P—13% by wt.

iii) Amine D* (dehydroabietylamine)—7% by wt.

iv) Sarcosine added as Lilaflot OS 100*—7% by wt.

v) Furnace oil—33% by wt.

* Trade Mark

The above ingredients were thoroughly mixed together to obtain an intimate mixture and then sparged with streams of pure oxygen for a period of 2 hours at ambient temperature.

The collector agent so obtained was designated as LX-5.

EXAMPLE 2

A phosphate ore originating in Florida was ground to a size range of −16 mesh +200 mesh. A laboratory flotation test was conducted on a sample of this ore utilizing conventional reagents. Analysis of the ore sample showed that it contained 7% by weight hosphorus pentoxide ($P_2O_5$), 40% by weight of silica as quartz and minor amounts of dolomite and calcite.

2000 grams of this ore were slurried in water, deslimed, and the slurry was then conditioned with sodium carbonate and sodium silicate. Conventional fatty acid emulsion was added as another conditioner at the rate of 2200 grams/ton. The latter conditioner is widely used by the Florida phosphate industry and is commonly known as Custo Float. Fuel oil, added at the rate of 600 grams/ton, was also added with the fatty acid. The ore slurry so conditioned was subjected to phosphate rougher flotation.

The concentrate obtained in the rougher flotation step was subsequently conditioned to have a pH value of about 3 by sulphuric acid addition. Sulphuric acid facilitated the removal of the fatty acid collector by subsequently washing the slurry. The washed concentrate was then repulped with fresh water, its pH adjusted to 3.5 by $H_2SO_4$ and an amine collector, commonly known as MG70*, was added to remove quartz and silica containing gangue into the froth.

* Trade Mark

The flowsheet of the conventional process is shown in FIG. 1.

The reagents and the results of the laboratory flotation separation tests are shown in Table 1.

TABLE 1

LABORATORY FLOTATION SEPARATION TEST FOR PHOSPHATES, USING CONVENTIONAL PLANT REAGENTS

A. REAGENTS

Conditioning:

$Na_2CO_3$ added at the rate of 500 g/t to adjust the pH of the deslimed slurry, and $Na_2SiO_3$ was added at 200 g/t Fatty Acid Flotation:

Commercially available fatty acid emulsion was added at the rate of 2.2 Kg/t.

Fuel oil was added at 0.6 Kg/t.

Amine Flotation:

Conditioning with $H_2SO_4$ at the rate of 2.50 Kg/t.

Amine (MG70*) was added at 0.30 Kg/t.

* Trade Mark

B: RESULTS

| PRODUCT | WEIGHT (%) | ASSAY, (%) $P_2O_5$ | % $P_2O_5$ DISTR'N |
|---|---|---|---|
| Amine Tail ($P_2O_5$) Conc. | 15.84 | 32.18 | 81.7 |
| Amine Conc. | 2.40 | 3.32 | 1.3 |
| Fatty Acid Conc. | 18.24 | 28.39 | 83.0 |
| Fatty Acid Tail. | 81.76 | 1.30 | 17.0 |
| Feed | 100.0 | 6.24 | 100.0 |

The results obtained in the laboratory flotation test reflected the separation attained in the commercial plant. It can be seen that more than 18% of the phosphate mineral contained in the ore was not recovered by the conventional process.

EXAMPLE 3

The phosphate ore originating in Florida and treated in a conventional mineral separation process described in Example 2, was treated in a froth flotation separation process utilizing the collector of the present invention. The schematic flowsheet of the mineral separation process is shown in FIG. 2.

Figure 2:
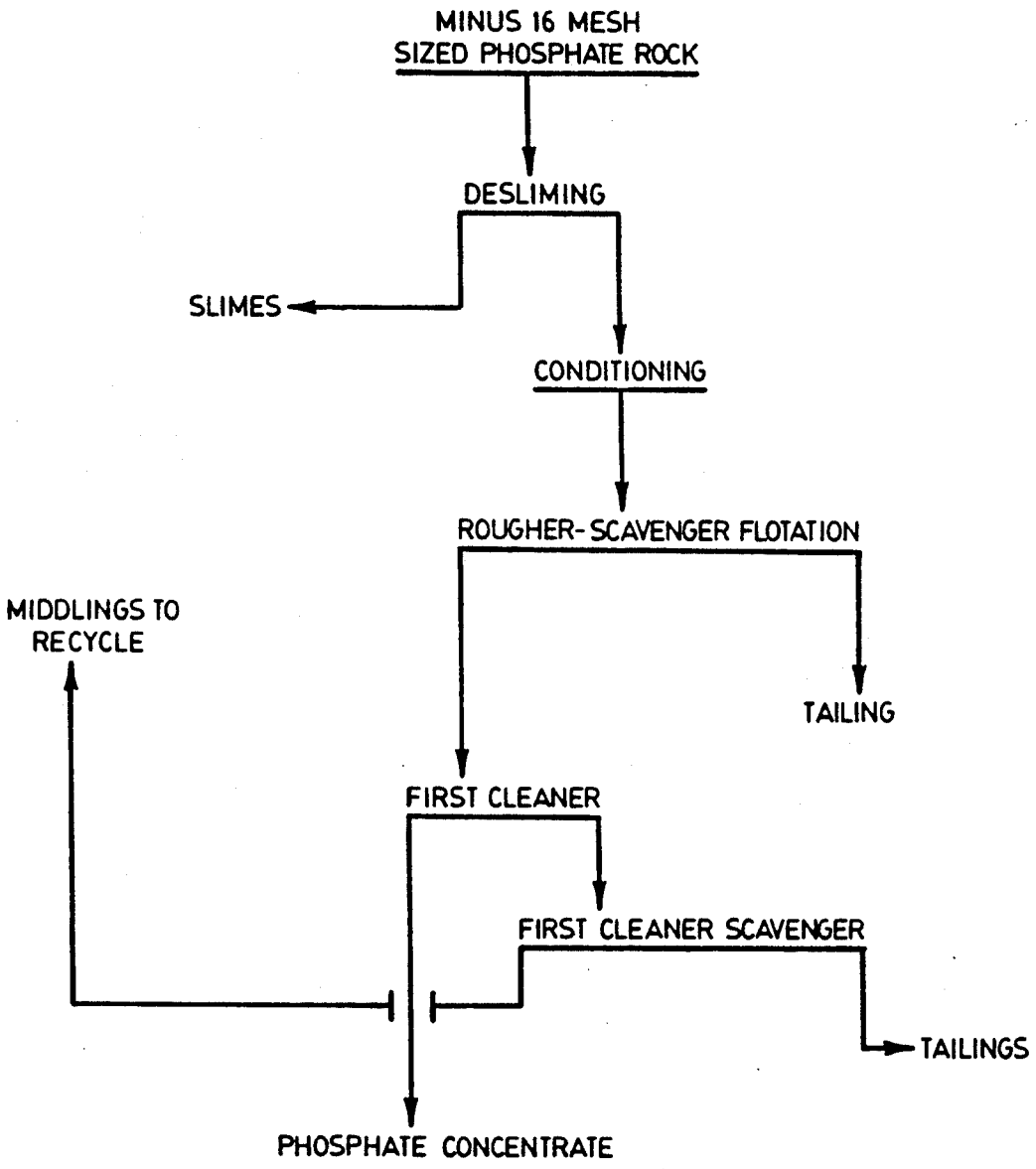
FIG. 2 and 3 are schematic flowsheets showing the phosphate beneficiation process of a phosphate rock and a phosphate slime, respectively, utilizing the collector agent of the present invention.

The phosphate mineral containing ore was ground, slurried in water and deslimed, as indicated in FIG. 2. The deslimed ore was then conditioned by adding sodium carbonate sodium silicate, and the collector LX-5 of the present invention, prepared as in Example 1.

The conditioned slurry was subsequently subjected to rougher-scavenger flotation steps. The tailing resulting in the flotation was discarded. The concentrate obtained was subjected to a first cleaner flotation step, yielding a phosphate cleaner concentrate. The tailing of the cleaner flotation separation step was subjected to a cleaner-scavenger flotation separation treatment. The tail resulting in the latter step was discarded and the concentrate (middlings) was recycled to the rougher stage.

The results of the mineral separation process utilizing the new collector of this invention are shown in Table 2.

In a continuous operation the tailing obtained in any of the cleaner flotation stages would be returned to the flotation stage preceding it.

TABLE 2

CONDITIONS AND METALLURGICAL RESULTS OBTAINED WITH COLLECTOR LX-5

A. REAGENT ADDITIONS

In conditioning the deslimed slurry: $Na_2CO_3$ was added at 500 g/t, and $Na_2SiO_3$ was added at 200 g/t. These reagents were supplemented in the cleaner flotation stages. In the first cleaner stage the additions were: $Na_2CO_3$ at 100 g/t and $Na_2SiO_3$ at 100 g/t.

In the cleaner-scavenger stage, both these reagents were added at 50 g/t.

LX-5 was added at 2000 g/t to the deslimed and conditioned ore. The LX-5 reagent was supplemented in the first cleaner stage at the rate of 100 g./t and in the first cleaner-scavenger stage at 35 g/t.

In a continuous operation LX-5 would be added at the rate of 100 g/t in the first cleaner-scavenger stage, and at the rate of 35 g/t at the second cleaner stage.

B. RESULTS

| PRODUCT | WEIGHT (%) | ASSAY, % | % $P_2O_5$ |
|---|---|---|---|
| $P_2O_5$ Cl. Conc. | 19.63 | 31.30 | 90.0 |
| Middlings | 4.44 | 7.54 | 4.9 |
| Flotation Tails | 75.93 | 0.46 | 5.1 |
| Feed | 100.00 | 6.83 | 100.00 |

It can be seen that more than 90% of the phosphate present in the ore has been retained in the cleaner concentrate, and only 5.1% was discarded in the final tailings. The new process shown in FIG. 2 and applied as described in Example 3 shows a substantial improvement in the recovery over that of the conventional process. Moreover, the amount of flotation reagents utilized by the new process is reduced. The sum total of the reagents used in the 2 conventional flotation steps is 3.1 Kg/t. There is a clear saving of cost by the new process in adding the LX-5 reagent at the rate of 2 Kg/t.

EXAMPLE 4

Figure 3:
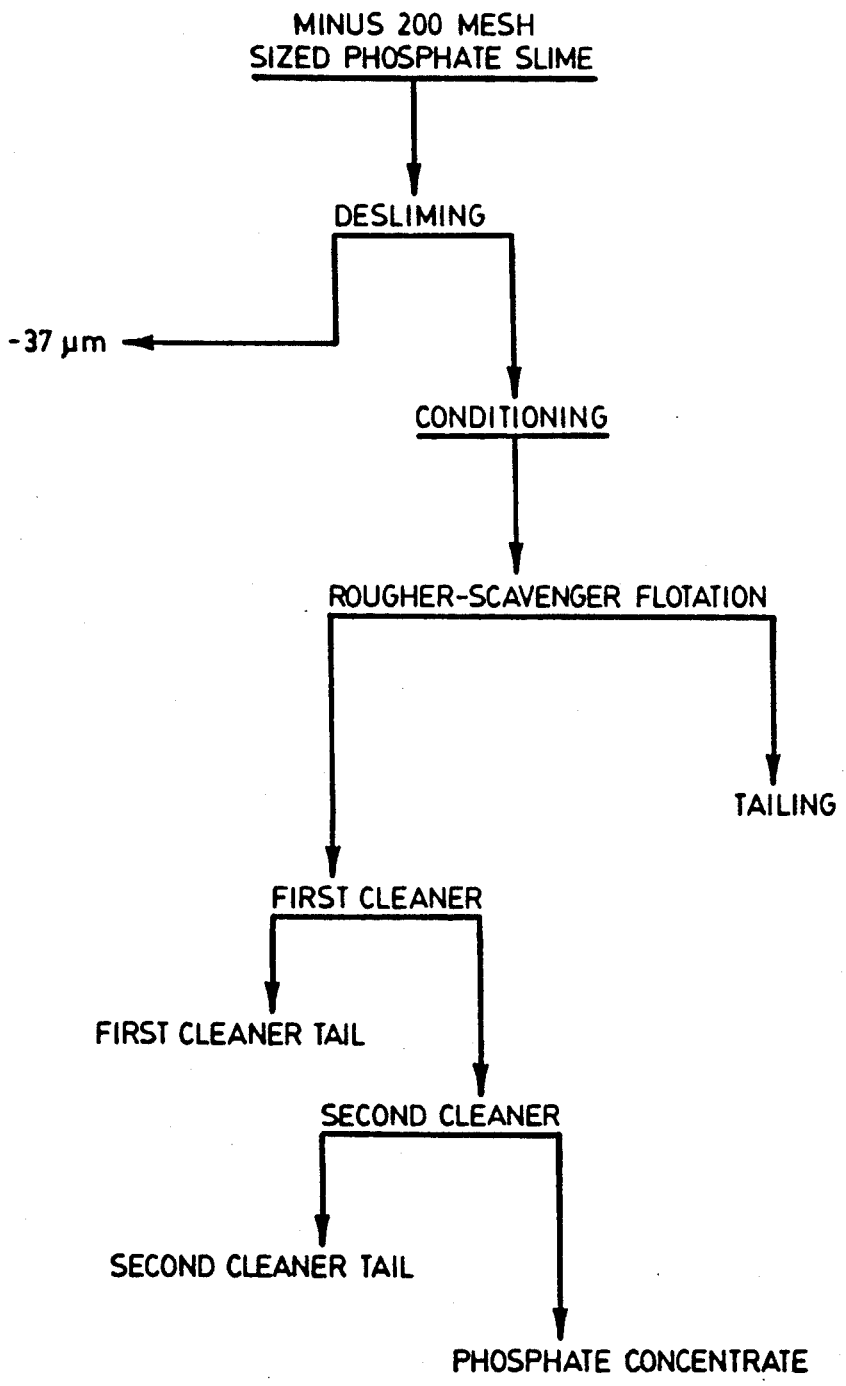

In the conventional phosphate recovery process conducted on a Florida ore and described in Example 2, the slimes obtained are normally discarded. Slimes, when analyzed, were found to be high in phosphate mineral content. As a laboratory test, the −200 mesh slime fraction obtained in the desliming step was repulped and subjected to a second desliming operation. In the second desliming, the slime containing −37 μm particles was discarded. The remaining +37 μm −74 μm (−200 mesh) sized ore particles were subjected to phosphate mineral separation process utilizing the phosphate collector of this invention. The process step sequence is schematically shown in FIG. 3.

The results obtained in the phosphate mineral flotation separation process conducted on the repulped slime portion of this Florida ore utilizing phosphate collector agent LX-5 are shown in Table 3.

TABLE 3

LABORATORY FLOTATION SEPARATION TEST CONDUCTED ON SLIMES OF +37μm −74μm PARTICLE SIZE RANGE

A. REAGENT ADDITION

Conditioning:

$Na_2CO_3$ addition: 750 g/t in the rougher-scavenger stage.

$Na_2SiO_3$ addition:

400 g/t in the rougher-scavenger, 200 g/t in the 1st cleaner and, 200 g/t in the 2nd cleaner flotation stage.

LX-5 addition: 2000 g/t in the rougher-scavenger stage.

B. RESULTS

| PRODUCT | WEIGHT (%) | ASSAY, % $P_2O_5$ | % $P_2O_5$ DISTR'N |
|---|---|---|---|
| $P_2O_5$ Cl. Conc. | 16.75 | 31.70 | 74.8 |
| Middlings | 6.43 | 17.23 | 15.6 |
| $P_2O_5$ Rougher Conc. | 23.18 | 27.70 | 90.4 |
| $P_2O_5$ Rougher Tail | 76.82 | 0.89 | 9.6 |
| Feed (+37 −74 μm) | 100.00 | 7.10 | 100.0 |

The above results show that a flotation separation treatment of slimes of particle size +37−74μm range, which were obtained by desliming phosphate mineral bearing ore, becomes very economical when utilizing the collector agent of the present invention. More than 90% of the phosphates contained in the slime fraction may be recovered in this process step. In conventional processes this fraction is usually rejected and the phosphate minerals contained therein are lost.

EXAMPLE 5

A phosphate ore originating in another mine in Florida and of somewhat different composition from that tested in previous examples, was subjected to laboratory froth flotation tests utilizing conventional process and reagents. A sample of the ore when analyzed showed that it contained 7.2 wt. % phosphorus pentoxide ($P_2O_5$).

1000 grams of this ore were ground to a size range of −20 Tyler mesh +200 Tyler mesh, then were slurried in water. The ore slurry was conditioned with sodium carbonate and sodium silicate. Conventional fatty acid collector, Westvaco L-5, was added to the conditioned ore at the rate of 669 g/t. Fuel oil was also added at the rate of 333 g/t, together with the fatty acid. The slurry of the conditioned ore was then subjected to a single stage froth flotation step which is referred to in the tabulated results as phosphate rougher flotation.

Reagents added to the slurry:

Conditioning:

$Na_2CO_3$ addition: 500 g/t $Na_2SiO_3$ addition: 500 g/t

Froth Flotation:

Westvaco L-5 added at 667 g/t,

Fuel oil added at 333 g/t.

Results of the test are shown in Table 4.

TABLE 4

| PRODUCT | WEIGHT (%) | ASSAY, % $P_2O_5$ | % $P_2O_5$ DISTR'N |
|---|---|---|---|
| Phosphate Rougher Conc. | 20.11 | 27.63 | 75.6 |
| Phosphate Rougher Tail. | 79.89 | 2.24 | 24.4 |
| Feed | 100.00 | 7.35 | 100.0 |

The results obtained in the laboratory froth flotation test reflected separations usually attained in commercial operations. It may be observed that using a conventional fatty acid collector nearly 25% of the phosphate minerals contained in the ore was lost in the flotation tailing.

EXAMPLE 6

The phosphate ore of Example 5 was treated in a phosphate mineral beneficiation process utilizing the collector agent of the present invention. The ground phosphate ore was slurried in water, conditioned by sodium carbonate and sodium silicate and was subsequently subjected to a single stage froth flotation test utilizing phosphate collector LX-5.

Reagents added to the slurry:

Conditioning:

$Na_2CO_3$ added at the rate of 500 g/t $Na_2SiO_3$ added at the rate of 500 g/t Froth Flotation:

LX-5 added at the rate of 1000 g/t

The collector agent was added at the same rate as the total of the amount of the conventional reagents added in Example 5.

Results of the test are shown in Table 5.

TABLE 5

| PRODUCT | WEIGHT (%) | ASSAY, % $P_2O_5$ | % $P_2O_5$ DISTR'N |
|---|---|---|---|
| Phosphate Rougher Conc. | 25.41 | 23.94 | 86.56 |
| Phosphate Rougher Tail. | 74.59 | 1.27 | 13.5 |
| Feed | 100.00 | 7.03 | 100.0 |

It may be readily seen that using phosphate collector LX-5 substantially increases the recovery of phosphate minerals contained in the ore. More than 86% of the phosphate minerals were retained in the concentrate obtained in a single stage froth flotation test. It is also shown that less than 14% of phosphates was rejected in the tail compared with more than 24% being rejected when conventional reagents were used.

EXAMPLE 7

Another phosphate collector agent having the composition described hereinabove was prepared by utilizing commercially available ingredients. The following ingredients were intimately mixed in the amounts shown below:

i) Fatty acid in the form of Westvaco L-5*—40% by weight ii) Tall oil pitch in the form of Tall Oil Pitch P—13% by weight iii) Amine in the form of Armeen C*—7% by weight iv) Sarcosine added as Lilaflot OS 100—7% by weight The balance was made up by furnace oil.

* Trade Mark

Armeen C is a commercially available amine derived from cocoamine and is marketed by AKZO Inc.

The above ingredients were thoroughly mixed together to obtain an intimate mixture then sparged with streams of pure oxygen for a period of 2 hours at ambient temperature.

The collector agent so obtained was designated as LX-7.

EXAMPLE 8

Another sample of the phosphate mineral bearing ore treated in Example 2 was subjected to single stage froth flotation tests utilizing the phosphate collector agent of the present invention.

1000 grams of the ground phosphate mineral containing ore was slurried in water and conditioned with the addition of sodium carbonate and sodium silicate. The phosphate collector agent of the present invention utilizing different commercially available ingredients was added to the aqueous slurry in similar amounts in separate froth flotation process tests. The efficiency of the froth flotation tests was then compared and tabulated.

The reagents were added as follows:

Conditioning:

$Na_2CO_3$ added at the rate of 500 g/t $Na_2SiO_3$ added at the rate of 500 g/t Froth Flotation:

Test A: LX-5 added at the rate of 2000 g/t

Test B: LX-7 added at the rate of 2000 g/t

The results of the froth flotation tests denoted as phosphate rougher concentrate and tail respectively, are shown in Table.6.

TABLE 6

| COLLECTOR | PRODUCT | WEIGHT (%) | ASSAY, % $P_2O_5$ | % $P_2O_5$ DISTR'N |
|---|---|---|---|---|
| TEST A | Phosphate Rougher Conc. | 33.73 | 20.90 | 96.2 |
| LX-5 | Phosphate Rougher Tail. | 66.27 | 0.42 | 3.8 |
| | Feed | 100.00 | 7.10 | 100.0 |
| TEST B | Phosphate Rougher Conc. | 23.38 | 25.47 | 92.3 |
| LX-7 | Phosphate Rougher Tail. | 76.62 | 0.65 | 7.7 |
| | Feed | 100.00 | 6.45 | 100.00 |

When comparing results of the froth flotation tests with the results of the conventional process described in Example 2, it may be seen that considerably improved phosphate mineral separation may be attained with either of the LX phosphate collector agents. The recovery is slightly lower with LX-7 than with LX-5, however there is notable improvement over the use of conventional reagents.

EXAMPLE 9

Another phosphate collector agent having the composition described hereinabove was prepared utilizing another type of commercially available ingredient. The following ingredients were intimately mixed in the amounts shown below.

i) Fatty acid in the form of Emersol 305*—40% by weight ii) Tall oil pitch in the form of Tall Oil Pitch P—13% by weight iii) Amine D (dehydroabietylamine)—7% by weight iv) Sarcosine added as Lilaflot OS 100—7% by weight The balance was made up by furnace oil.

* Trade Mark

Emersol 305* is a commercially available fatty acid having a predominant hydrocarbon chain length of 16–18 carbon atoms. This composition is high in linoleic acid. Emersol 305 is manufactured and marketed by the Emery Co.

* Trade Mark

The above ingredients were thoroughly mixed together to obtain an intimate mixture and then sparged with streams of pure oxygen for a period of 2 hours at ambient temperature.

The collector agent so obtained was denoted as LX-8.

EXAMPLE 10

Another sample of the phosphate mineral bearing ore treated in Example 2 was subjected to a single stage froth flotation test utilizing variants of the phosphate collector agent prepared according to the present invention. The results obtained were compared with the mineral separation attained by a conventional process and reagent.

1000 grams of the ground phosphate mineral containing ore was slurried in water and conditioned with the addition of sodium carbonate and sodium silicate. The phosphate collector agent prepared according to the present invention utilizing different commercially available ingredients was added to the aqueous slurry of conditioned ore in similar amounts in separate froth flotation tests. The results of froth flotation tests were then tabulated, and their efficiency compared.

The reagents were added as follows:

Conditioning:

$Na_2CO_3$ added at the rate of 500 g/t, $Na_2SiO_3$ added at the rate of 500 g/t Froth Flotation:

Test C: LX-5 added at the rate of 500 g/t

Test D: LX-8 added at the rate of 500 g/t

The results of the froth flotation tests, denoted as phosphate rougher concentrate and tail respectively, are shown in Table 7.

TABLE 7

| COLLECTOR | PRODUCT | WEIGHT (%) | ASSAY, % $P_2O_5$ | % $P_2O_5$ DISTR'N |
|---|---|---|---|---|
| TEST C | Phosphate Rougher Conc. | 17.72 | 31.17 | 89.3 |
| LX-5 | Phosphate Rougher Tail. | 82.28 | 0.80 | 10.8 |
| | Feed | 100.00 | 6.18 | 100.00 |
| TEST D | Phosphate Rougher Conc. | 19.67 | 29.95 | 92.3 |
| LX-8 | Phosphate Rougher Tail. | 80.33 | 0.61 | 7.7 |
| | Feed | 100.00 | 6.38 | 100.00 |

It may be seen from the above Table that phosphate collector agents LX-5 and LX-8 lead to similar recovery rates. The recovery of phosphate minerals from its ore has been improved substantially over that obtained in a conventional process by the use of the phosphate collector agent prepared according to the present process.

It is to be also noted that the phosphate collector agent in this example was added at a substantially reduced rate compared to the rate of addition of the conventional collector in Example 2. Thus the advantage in utilizing the phosphate collector agent of this invention in a froth flotation process is manifested by not only in improved recovery of phosphate minerals from its ores, but also at a significantly lower cost.

EXAMPLE 11

Another phosphate collector embodying the new phosphate collector agent of this invention was prepared utilizing commercially available ingredients in a composition which is somewhat different from that described in Example 1.

The following ingredients were mixed in amounts shown below:

i) Fatty acid in the form of Westvaco L-5—53% by wt.

ii) Tall oil pitch in the form of Tall Oil Pitch P—7% by wt.

iii) Amine in the form Amine D—7% by wt.

The balance of 33% wt. % was made up by fuel oil.

The above listed ingredients were thoroughly mixed together to obtain an intimate mixture and the mixture was then sparged with streams of pure oxygen for a period of 2 hours at ambient temperature.

The collector agent so obtained was designated LX-9.

EXAMPLE 12

Another phosphate collector agent containing the same commercially available ingredients as described in Example 1, albeit in a different composition, was prepared.

The following ingredients were mixed in the amounts shown below.

i) Fatty acid in the form of Westvaco L-5—30% by wt.

ii) Tall oil pitch in the form of Tall Oil Pitch P—17% by wt.

iii) Amine in the form of Amine D—10% by wt.

iv) Sarcosine added in the form of Lilaflot OS 100—10% by wt.

The balance of 33% was provided by fuel oil.

The above listed ingredients were thoroughly mixed together to obtain an intimate mixture then the mixture was sparged with streams of pure oxygen for a period of 2 hours at ambient temperature.

The collector agent of this example was designated LX-10.

EXAMPLE 13

Another sample of the phosphate mineral bearing ore treated in Example 2 was subjected to laboratory testing utilizing the phosphate collector agent of the present invention. 1000 grams of the ground phosphate mineral containing ore were slurried in water and conditioned with the addition of sodium carbonate and sodium silicate. The phosphate collector agent of the present invention utilizing commercially available ingredients in different proportions, was added to the aqueous slurry in similar amounts, in separate froth flotation process tests. The results of the froth flotation tests were then tabulated and compared.

The reagents were added as follows:

i) Rougher stage conditioning:

Sodium carbonate ($Na_2CO_3$) added at the rate of 500 g/t

Sodium silicate ($Na_2SiO_3$) added at the rate of 500 g/t ii) Froth flotation reagents added:

Test E: LX-5 added at the rate of 1000 g/t

Test F: LX-9 added at the rate of 1000 g/T

Test G: LX-10 added at the rate of 1000 g/t iii) In each of the first and second cleaner stages conditioning reagents were added:

Sodium carbonate ($Na_2CO_3$) at the rate of 100 g/t

Sodium silicate ($Na_2SiO_3$) added at the rate of 200 g/t

The results of froth flotation Tests E, F, and G, are shown in Table 8.

The final concentrate obtained in the three-stage froth flotation tests is denoted as Phosphate cleaner concentrate. The combined tailing of the first two stages is denoted as Phosphate tail (1st cleaner +rougher), and the tail of the third stage is denoted as Phosphate 2nd cleaner tail, respectively.

TABLE 8

| COLLECTOR | PRODUCT | WEIGHT (%) | ASSAY, % $P_2O_5$ | % $P_2O_5$ DISTR'N |
|---|---|---|---|---|
| Test E | Phosphate cleaner conc. | 16.04 | 32.90 | 79.9 |
| LX-5 | Phosphate 2nd clean. tail | 4.85 | 22.08 | 16.2 |
| | Phosphate (1st cleaner + rougher) tail | 79.11 | 0.33 | 3.9 |
| | Feed | 100.0 | 6.61 | 100.0 |
| Test F | Phosphate cleaner conc. | 19.44 | 30.62 | 91.7 |
| LX-9 | Phosphate 2nd clean. tail | 4.36 | 2.10 | 1.4 |
| | Phosphate (1st cleaner + rougher) tail | 76.20 | 0.59 | 6.9 |
| | Feed | 100.0 | 6.49 | 100.0 |
| Test G | Phosphate cleaner conc. | 18.87 | 31.51 | 95.9 |
| LX-10 | Phosphate 2nd clean. tail | 1.05 | 4.89 | 0.8 |
| | Phosphate (1st cleaner) rougher) tail | 80.09 | 0.26 | 3.3 |
| | Feed | 100.0 | 6.20 | 100.0 |

It may be seen in Test E that less phosphate is retained in the Phosphate cleaner concentrate, however, this is contained in a smaller ore portion. The phosphate recovery is higher in Test F than in Test E, but more phosphate is lost in the combined tailing. The highest phosphate recovery is obtained in Test G, with the lowest amount of phosphate retained in the combined tailing. It is shown that the composition of LX-10 is the most suitable froth flotation reagent for the recovery of the phosphate mineral bearing ore of Example 13.

Any one of the three LX reagents tested in Example 13 will provide more superior recovery of phosphate minerals than the conventional reagents and process tested previously.

It has been shown that the phosphate collector agent of the present invention may be obtained by utilizing several commercially available ingredients. It has also been shown that the composition ranges embodied by the best mode of practising the invention may be adjusted to the particular requirements of the phosphate mineral bearing ore to be beneficiated.

Furthermore, the froth flotation separation process steps utilizing the present invention are simpler, therefore less costly, and require smaller quantities of collector agent per tonne than conventional processes.

Although the present invention has been described specifically with reference to the preferred embodiments, it is to be understood that modifications and variations may be resorted to without departing from the spirit and scope of the invention, as those skilled in the art will readily understand. Such modifications and variations are considered within the purview and scope of the invention and the invention as claimed.

I claim:

1. A process for the froth flotation separation of phosphate minerals contained in a phosphorus-containing ore, comprising the steps of:

a) preparing a phosphate mineral collector agent by mixing ingredients initially comprising:
   i) 20–60% by weight of a fatty acid containing 12–36 carbon atoms in its hydrocarbon chain,
   ii) 5–25% by weight of a tall oil pitch,
   iii) 2.5–15% by weight of an amine derived from a plant,
   iv) 0–15% by weight of sarcosine; and
   oxidizing said mixture by means of a method selected from the group consisting of: sparging with an oxygen-containing gas, adding a liquid oxidizing agent and adding a solid oxidizing agent; and
   thereafter adding to the oxidized mixture, as the balance, 20–72.5% by weight of one member of the group consisting of fuel oil and furnace oil;
b) grinding a phosphate mineral-bearing ore, and thereafter slurrying said ground core in water;
c) conditioning the ore slurry by adding thereto conditioning agents and the phosphate mineral collector agent resulting in step a) followed by agitaton;
d) subjecting the ore slurry so conditioned to froth flotation separation, and thereafter separating a phosphate mineral concentrate-bearing froth and treating said phosphate mineral concentrate for phosphate recovery.

2. A process for the froth flotation separation of phosphate minerals contained in a phosphorus-containing ore, comprising the steps of:

a) preparing a phosphate mineral collector agent by mixing ingredients initially comprising:
   i) 20–60% by weight of a fatty acid containing 12–36 carbon atoms in its hydrocarbon chain,
   ii) 5–25% by weight of a tall oil pitch,
   iii) 2.5–15% by weight of an amine derived from a plant,
   iv) 0–15% by weight of sarcosine; and
   v) as the balance, 20–72% by weight one member of the group consisting of fuel oil and furnace oil, and
   thereafter oxidizing said mixture of ingredients listed above by means of a method selected from the group consisting of: sparging with an oxygen-containing gas, adding a liquid oxidizing agent and adding a solid oxidizing agent;
b) grinding a phosphate mineral-bearing ore, and thereafter slurrying said ground core in water;
c) conditioning the ore slurry by adding thereto conditioning agents and the phosphate mineral collector agent resulting in step a) followed by agitation;
d) subjecting the ore slurry so conditioned to froth flotation separation, and thereafter separating a phosphate mineral concentrate-bearing froth and treating said phosphate mineral concentrate for phosphate recovery.

3. A process as claimed in claim 1 or 2, wherein said ore slurry is subjected to a desliming step prior to said froth flotation separation, yielding a deslimed ore slurry and a slime fraction.

4. A process as claimed in claim 3, wherein the slime factor separated from the ore is also subjected to froth flotation separation of phosphate minerals utilizing said phosphate mineral collector agent.

5. A process as claimed in claim 1 or 2, wherein said conditioning agents are at least one of the group consisting of: sodium carbonate and sodium silicate.

6. A process according to claim 1 or 2, wherein said froth flotation separation comprises at least a rougher flotation and a cleaner flotation stage.

7. A process as claimed in claim 1 or 2, wherein the selected method of oxidation is sparging with an oxygen containing gas, and said gas is selected from the group consisting of: air, oxygen enriched air and pure oxygen.

* * * * *